United States Patent [19]

Roth

[11] 4,379,749

[45] Apr. 12, 1983

[54] WATER DEFLECTOR ASSEMBLY FOR SWIMMING POOL SKIMMERS

[76] Inventor: Daniel T. Roth, 17018 Aspen Way, Morgan Hill, Calif. 95037

[21] Appl. No.: 310,834

[22] Filed: Jan. 13, 1981

[51] Int. Cl.[3] ..... E04H 3/16

[52] U.S. Cl. ..... 210/169; 210/540; 4/490

[58] Field of Search ..... 210/169, 523.5, 540

[56] References Cited

U.S. PATENT DOCUMENTS

| | | | |
|---|---|---|---|
| 3,152,076 | 10/1964 | Kreutzer | 210/540 |
| 3,244,284 | 4/1966 | Shaffer | 210/169 |
| 3,625,364 | 12/1971 | LaChance | 210/169 |
| 4,068,327 | 1/1978 | Heinlien | 210/169 |
| 4,225,436 | 9/1980 | Csen | 210/169 |

*Primary Examiner*—Charles N. Hart
*Assistant Examiner*—Sharon T. Cohen
*Attorney, Agent, or Firm*—Paul L. Hickman

[57] ABSTRACT

A water deflector assembly characterized by an elongated water deflector, and an adaptor block which couples the water deflector to a pre-existing skimmer provided in the sidewall of a swimming pool. The adaptor block allows a standardized deflector to be attached to a number of different skimmer brands. The water deflector includes an elongated central portion and two oppositely deflected end portions, and is designed to minimize eddy currents and maximize the amount of water deflected towards the skimmer for a given deflector length.

5 Claims, 7 Drawing Figures

WATER DEFLECTOR ASSEMBLY FOR SWIMMING POOL SKIMMERS

BACKGROUND OF THE INVENTION

1. Field of the Invention

This invention relates generally to swimming pool equipment and more particularly to devices used to direct water towards a swimming pool's skimmer opening.

2. Description of the Prior Art

A typical swimming pool filtration system includes an inlet, known as a skimmer, a filter having one end coupled to the skimmer, and a pump coupling the other end of the filter to an outlet. The outlet is designed to eject the filtered water so as to create a current which flows around the inner periphery of the pool towards the skimmer. Debris floating on the surface of the water is urged towards the skimmer by this current and is thus removed from the pool.

A problem with the typical skimmer system is that it is inefficient due to the fact that the current created by the outlet often sweeps the floating debris past the skimmer. In recognition of this problem, a number of prior art patents including U.S. Pat. Nos. 3,152,076 of Kreutzer, 4,068,327 of Heinlein, 4,089,074 of Sermons, and 3,625,364 of La Chance describe devices for deflecting water towards a swimming pool's skimmer. The devices described in the above cited patents are all characterized by an elongated deflector attached to the wall of the swimming pool and angled so as to direct the aforementioned peripheral current towards the skimmer.

A disadvantage of the prior art deflectors is that they create eddy currents which substantially reduce their effectiveness. A first eddy current is created on the skimmer side of the deflector which has the effect of moving some of the floating debris away from the skimmer, and a second eddy current is created on the outlet side of the deflector, with the effect of removing some debris from the peripheral current.

Other disadvantages of the cited prior art deflectors include their relative complexity and their difficulty of installation and removal. For example, all of the cited prior art patents either require a modification the the pool or a complex assembly of clamps and/or anchors to attach the deflector to the pool.

SUMMARY OF THE INVENTION

A major object of this invention is to provide a deflector for skimmers which minimizes eddy currents and which maximizes the amount of water deflected to the skimmer outlet for a given deflector length.

Another major object of this invention is to provide means for coupling a deflector to the pool's sidewall which is easy to install and remove, and which does not require pool modification, nor the use of clamps, anchors or the like.

A further object of this invention is to provide a deflector assembly that is inexpensive to manufacture and rugged and longlasting in use.

Briefly, the invention includes an adaptor block designed to attach to a swimming pool skimmer, and an elongated water deflector removably attached to the adaptor block. Pool owners purchase the adaptor block designed for their particular brand of skimmer. The water deflector has an elongated central portion and end portions which angularly deflect from the central portion in opposite directions. The end portions should be roughly parallel, and optimally should deflect from the central portions within the inclusive range of 30° to 60°.

Since the end portions are parallel and oppositely deflected from the central portion, the end of the deflector farthest into the pool meets the peripheral current of the pool head on. It is this design which maximizes the deflection of the water towards the skimmer outlet and minimizes the negative effects of eddy currents.

Thus, a major advantage of this invention is that the deflector is more efficient than the deflectors of the prior art.

Another major advantage of this invention is that a the attachment of the adaptor block to the pre-existing, threaded bore holes of the skimmer is far more efficient and effective than the prior art means for coupling the deflector to the pool.

Yet another advantage of this invention is its simplicity, which allows for inexpensive manufacture and high reliability.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
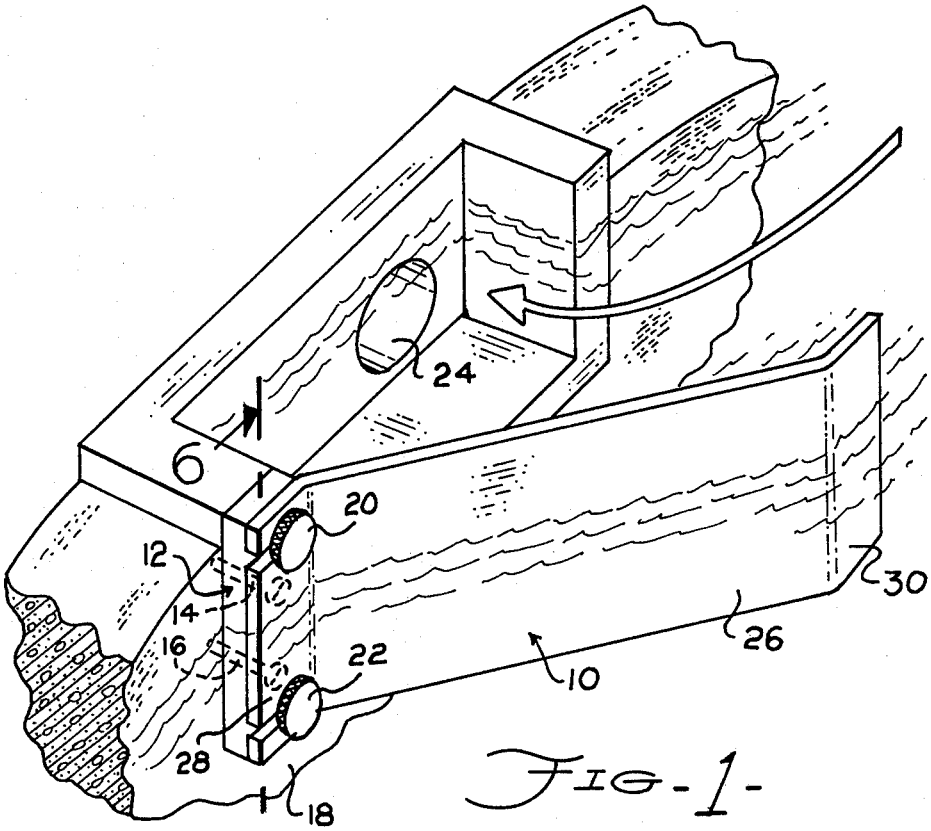
FIG. 1 is a perspective view of the present invention attached to the wall of a swimming pool proximate a skimmer.

With reference to FIG. 1, a water deflector assembly in accordance with the present invention includes an elongated water deflector 10, a adaptor block 12, a pair of fasteners 14 and 16 attaching the adaptor block to the skimmer 17 set within a sidewall 18 of a swimming pool, and a pair of fasteners 20 and 22 attaching the water deflector to the adaptor block. The deflector is angled to direct water towards the skimmer's outlet 24.

Figure 2:
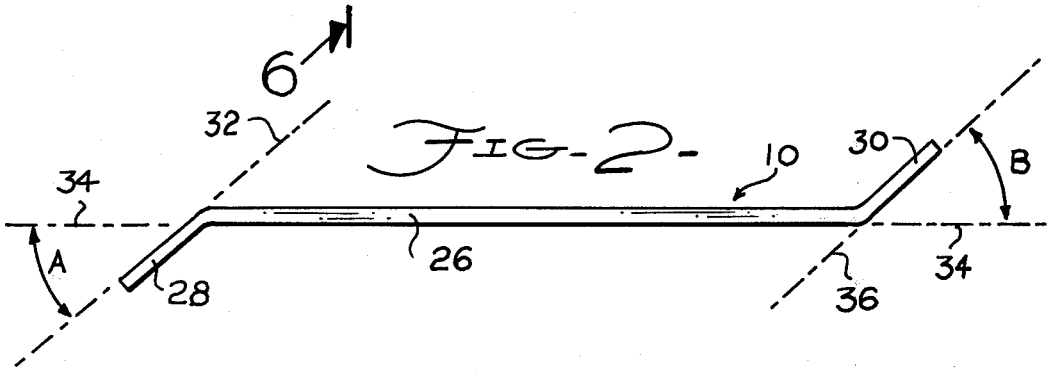
FIG. 2 is a top plan view of the water deflector shown in FIG. 1.

With reference to FIG. 2, a preferred embodiment of the water deflector has an elongated, substantially planar central portion 26, a first end portion 28 angularly deflected from the central portion, and a second end portion 30 also angularly deflected from the central portion. As noted in the figure, a plane 32 along which end portion 28 lies intersects a plane 34 along which the central portion lies at a first angle 'A', and a plane 36 along which the second end portion 30 lies intersects the plane 34 along which the central portion lies at a second angle 'B'.

For maximum efficiency angles A and B are the same so that the two end portions are parallel. It has been determined empirically that angles A and B should be within the range of 30° and 60° to deflect the water most efficiently.

Figure 3:
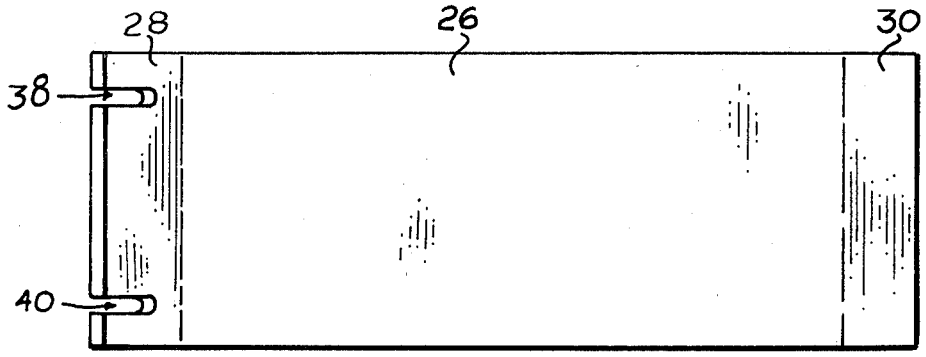
FIG. 3 is a front elevational view of the water deflectors of FIGS. 1 and 2.

As noted in FIG. 3, end portion 28 is provided with a pair of parallel slots 38 and 40 which are receptive to the shanks of the fasteners 20 and 22. The deflector is preferably constructed from a strong, flexible, non-corrosive material such as an acrylic plastic.

Figure 4:
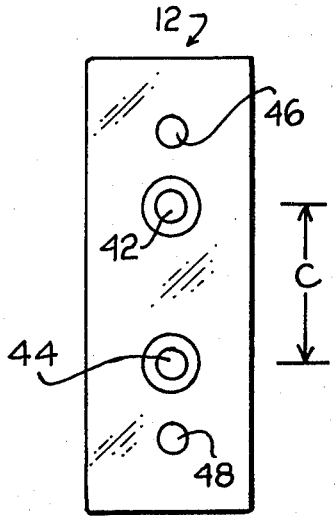
FIG. 4 is a front elevational view of the adaptor block shown in FIG. 1.

In FIG. 4 the adaptor block is shown to include a first pair of countersunk bore-holes 42 and 44 receptive to screw fasteners 14 and 16, and a second pair of threaded bore holes 46 and 48 receptive to threaded thumbscrews 20 and 22. The center-to-center distance between bore holes 42 and 44 (labeled 'C') varies dependent upon the brand of skimmer the present invention is to be used with, while the center-to-center distance between bore holes 46 and 48 (labeled 'D') is typically about 3¾ inches. In this way an appropriate adaptor block can adapt a standard water deflector for attachment to a number of brands of skimmer outlets. For example, the distance C between bore holes 42 and 44 is about 2.125 inches for a Muskin TM standard skimmer, about 2.500 inches for a Muskin TM deluxe skimmer, about 2.250 inches for a Dough Boy TM skimmer, and about 2.125 inches for a Hayward TM skimmer.

Figure 5:
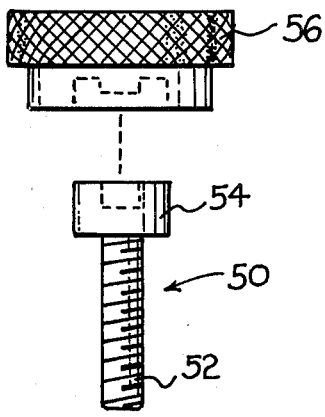
FIG. 5 is an exploded elevational view of the thumbscrew fastener shown in FIG. 1.

In FIG. 5 an exploded view of the thumbscrews 20 and 22 shows a bolt 50 having a threaded shank 52 and a head 54. A thumb-wheel cap 56 is press fitted upon head 54 of the bolt.

Figure 6:
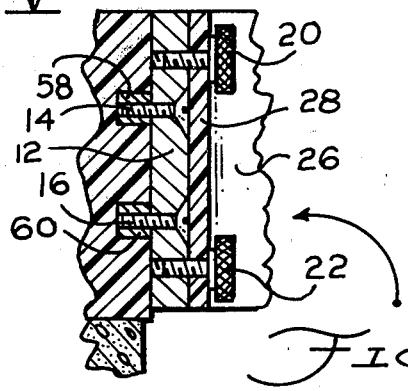
FIG. 6 is a cross-sectional view taken along line 6—6 of FIG. 1.

In the cross sectional view of FIG. 6, the attachment of the adaptor block is shown. Screw fasteners 14 and 16 engage threaded inserts 58 and 60 of the skimmer. Once attached, the adaptor block may remain in position. Thumbscrews 20 and 22 attach the water deflector to the adaptor block. Thus, the water deflector can be easily attached and removed from the adaptor block.

Figure 7:
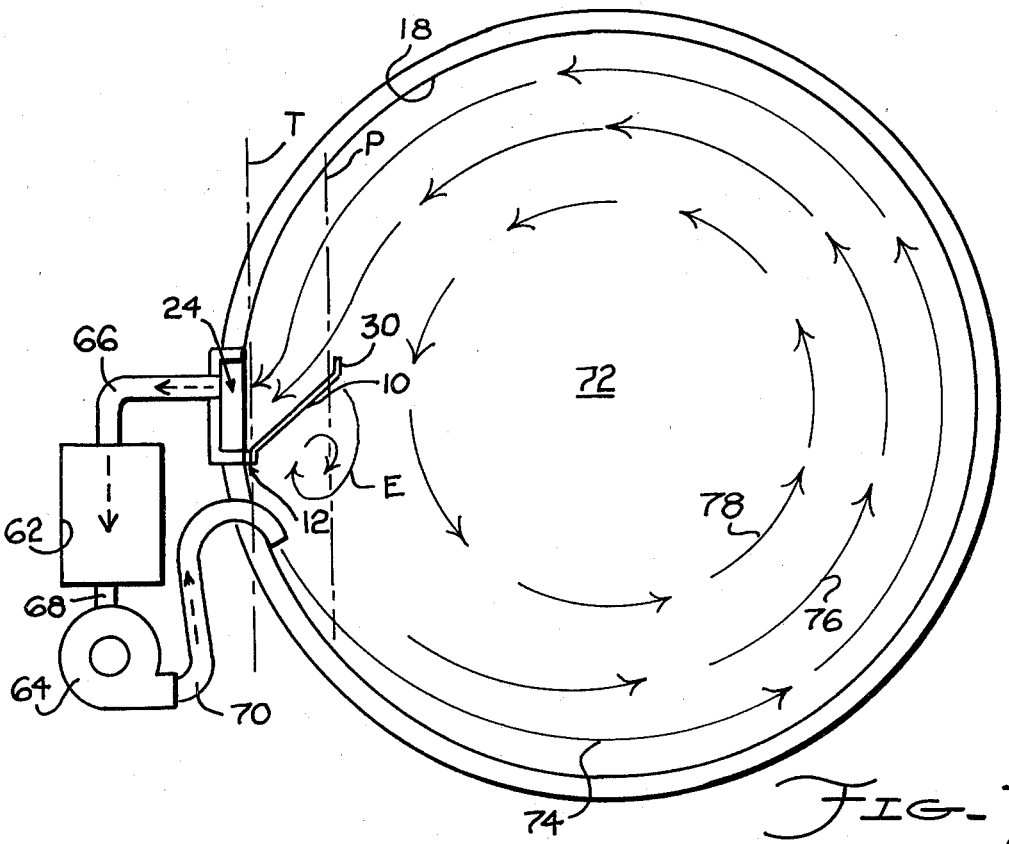
FIG. 7 is a view of the present invention operationally installed within a swimming pool.

In FIG. 7 a water deflector 10 is operationally attached to a skimmer 24 by its adaptor block 12. For the pool shown the sidewall is circular, although other pool configurations, such as rectangular and kidney shaped, also work well with the present device. The pool's filtering system includes a filter 62, a pump 64, a hose 66 coupling the skimmer outlet to the filter, a hose 68 coupling the the filter to the pump, and an outlet hose 70 having one end coupled to the pump and having its other end communicating with the water 72 within the pool.

As noted in the figure, the water ejected from the end of hose 70 sets up a peripheral current 74, and a number of weaker, secondary currents such as 76 and 78. As with the prior art deflectors the majority of the peripheral current is directed into the skimmer by the deflector. However, the present invention additionally directs many of the weaker secondary currents such as current 76 towards the skimmer. This unexpected result of greater deflection is due to second end portion 30 which lies along a plane 'P' which is substantially parallel to a tangential plane 'T' at the point where the adaptor block is attached to the skimmer. Of course, if the pool had planar side then the plane 'P' would be parallel to the side of the pool.

With prior art deflectors most of secondary stream 76 curls around the end of the deflector due to the principles of refraction. This creates large eddy currents both on the skimmer side of the deflector and on the outlet side of the deflector. These eddy currents trap debris away from the skimmer outlet and thus reduce the efficiency of the filtering system. With the present device, the eddy current on the skimmer side of the deflector is all but eliminated, and the eddy current 'E' on the outlet side of the deflector is inconsequentially small.

The present device is preferably constructed from a strong, flexible material such as acrylic plastic. The components of the deflector assembly should be inert so that they do not react to the water, chlorine, salts, and other materials within the pool.

While this invention is described in terms of a few preferred embodiments, it is contemplated that persons reading the preceding descriptions and studying the drawing will realize various alterations, permutations and modifications thereof. For example, the adaptor block and the deflector could be constructed as an single unit, as long as the free end of the deflector was still angled to face directly into the oncoming current.

It is therefore intended that the following appended claims be interpreted as including all such alterations, permutations and modifications as fall within the true spirit and scope of the present invention.

What is claimed is:

1. A water deflector assembly for deflecting water towards a skimmer provided in the wall of a swimming pool, the water deflector comprising:
   (a) an adaptor block;
   (b) means coupling said adaptor block proximate to said skimmer;
   (c) an elongated water deflector having a substantially planar central portion, a first end portion angularly deflected from said central portion, and a second end portion angularly deflected from said central portion in a second direction substantially opposite said first direction, where said first end portion and said second end portion are substantially planar and parallel; and
   (d) means attaching said first end portion to said adaptor block such that said second end portion is substantially parallel to said skimmer, and such that an upper surface of said deflector protrudes above the surface of the water within said pool.

2. A water deflector assembly as recited in claim 1 wherein the angle between said first end portion and said central portion is within the range of 30° and 60°, inclusive.

3. A water deflector assembly as recited in claim 2 wherein said adaptor block is substantially a rectangular prism provided with a first pair of spaced apart bores, and a second pair of spaced apart, threaded bores.

4. A water deflector assembly as recited in claim 3 wherein said first pair of spaced apart bores are receptive to fasteners which attach said adaptor block to said swimming pool wall, and said second pair of spaced apart, threaded bores are receptive to a pair of fasteners engaged with said first end portion.

5. A water deflector assembly as recited in claim 1 wherein said water deflector assembly has a specific gravity greater than that of the water within said pool and thus cannot float.

* * * * *